US006200158B1

(12) United States Patent
Robinson

(10) Patent No.: US 6,200,158 B1
(45) Date of Patent: Mar. 13, 2001

(54) APPARATUS FOR MOUNTING AN EXTERNAL RECEPTACLE TO A WATTHOUR METER SOCKET ADAPTER

(75) Inventor: Darrell Robinson, Highland Township, MI (US)

(73) Assignee: Ekstrom Industries, Inc., Farmington Hills, MI (US)

( * ) Notice: Subject to any disclaimer, the term of this patent is extended or adjusted under 35 U.S.C. 154(b) by 0 days.

(21) Appl. No.: 09/261,305

(22) Filed: Mar. 2, 1999

Related U.S. Application Data

(60) Provisional application No. 60/076,883, filed on Mar. 5, 1998.

(51) Int. Cl.[7] ..... H01R 33/945; H01R 13/44

(52) U.S. Cl. ..... 439/517; 439/146

(58) Field of Search ..... 439/517, 146, 439/167, 508, 733.1; 361/666, 665, 664, 659, 661

(56) References Cited

U.S. PATENT DOCUMENTS

| | | | | |
|---|---|---|---|---|
| 4,977,482 | * | 12/1990 | Langdon et al. | 361/366 |
| 5,097,383 | | 3/1992 | Heard et al. . | |
| 5,216,802 | | 6/1993 | Cole et al. . | |
| 5,590,179 | | 12/1996 | Shincovich et al. . | |
| 5,704,804 | * | 1/1998 | Robinson et al. | 439/517 |
| 5,851,038 | | 12/1998 | Robinson . | |

OTHER PUBLICATIONS

Ekstrom Industries, Inc.; Meter Evaluator for Fast, Accurate, Meter Check; Bulletin 3715, Apr. 1, 1980.
Ekstrom Industries, Inc.; Voltage & Current Recording Package; Bulletin El–ERP–989–5M.
Ekstrom Industries, Inc.; Temporary Metered Power Device; Paper No. EK–TMP–991–2M.

* cited by examiner

*Primary Examiner*—Brian Sircus
*Assistant Examiner*—Chandrika Prasad
(74) *Attorney, Agent, or Firm*—Young & Basile, PC

(57) ABSTRACT

An apparatus for mounting an enclosure to a watthour meter socket adapter includes a mounting strap lockingly encircleable about a side wall of the socket adapter and the enclosure connected to the strap for positioning exteriorly adjacent the side wall of the socket adapter. The interior of the enclosure is disposed in communication with the interior of the socket adapter through aligned apertures in the enclosure, socket adapter and strap for the passage of an electrical conductor therethrough. A releasable lock is carried on the strap for releasably locking the ends of the strap about the side wall of the socket adapter. In one embodiment, the enclosure includes a receiver having a first portion attached to the strap and a second wall portion. The enclosure is mounted in the receiver. Fasteners extend through the enclosure into the second wall portion for securing the enclosure on the wall portion. A removable cover is optionally provided on the enclosure to enable separate access to the enclosure. Alternately, the strap includes first and second strap portions, with one end of each strap portion connectable to the enclosure. Engagable lock members are mounted on the opposed ends of the strap portions.

15 Claims, 6 Drawing Sheets

APPARATUS FOR MOUNTING AN EXTERNAL RECEPTACLE TO A WATTHOUR METER SOCKET ADAPTER

CROSS REFERENCE TO CO-PENDING APPLICATION

This application claims the benefit of the priority date of co-pending Provisional Application Ser. No. 60/076,883, filed Mar. 5, 1998 in the name of Darrell Robinson, the entire contents of which are incorporated herein by reference.

BACKGROUND OF THE INVENTION

1. Field of the Invention

The present invention relates, in general, to electrical apparatus and, specifically, to electrical watthour meter socket adapters and related watthour meter apparatus.

2. Description of the Art

In the electric utility industry, plug-in, socket-type watthour meters are commonly employed to measure electric power consumption at a residential or commercial building establishment. A socket is mounted on a wall of the residence or building and contains terminals which are connected to electric line and electric load conductors. The terminals are also connected to internal conductors within the socket which extend to jaw contacts positioned to receive the blade terminals of a plug-on watthour meter to complete an electric circuit through the watthour meter between the line and load terminals and the conductors.

One type of meter socket has a ring-type cover which includes an outwardly projecting, annular mounting flange surrounding an opening in the cover through which the blade terminals of a watt hour meter extend. The mounting flange is sized to mate with a complementary formed mounting flange on the bottom of the watthour meter.

Another type of meter socket known as a ringless or clamp jaw socket has an aperture in the socket cover sized to secure the meter flange within the socket cover. The shell of the socket adapter, after the socket adapter is mounted in the jaw contacts of the watthour meter socket, extends through the aperture in the socket cover and receives a watthour meter in a snap-in connection.

It is common to add various additional features and components to a meter service application, such as surge suppression, circuit breakers, automatic meter reading, communication systems, etc., which the service was not originally designed to accept or utilize. Such components have often been mounted in a separate enclosure or receptacle which is attached to an existing watthour socket adapter, or built in to the interior of the socket adapter with special modifications to the shell and/or terminal portions of the adapter to provide sufficient space to house the additional components.

In certain meter sockets, such as ringless or clamp jaw sockets, there is insufficient aperture size in the meter socket cover to enable an enlarged socket adapter or a socket adapter having a separate receptacle or enclosure mounted thereon to fit through the socket cover meter aperture.

One solution to this problem utilizes a conventional watthour meter socket adapter/extender which is connected to the jaw contacts in a watthour meter socket. The shell portion of the socket adapter/extender extends outward through the aperture in the ringless-style watthour meter socket cover. A separate housing containing additional features or components is attached to a bottom portion of the shell by means of screws extending through adjacent surfaces on the socket adapter/extender shell and the separate housing. Aligned apertures in the shell and the enclosure allow for the passage of electrical conductors between the conductive elements in the watthour meter socket adapter and components or terminals in the separate housing.

This solution, however, is not without problems. Although the housing containing additional features is accessible separately from the watthour meter mounted in the socket adapter/extender to enable replacement or updating of the additional features without removing the watthour meter, any removal or mounting of the housing to or from the shell of the socket adapter/extender typically requires the removal of the watthour meter from the socket adapter/extender. Industry standards require that the watthour meter can only be removed by an authorized utility company serviceman. The authorized utility company serviceman is the only individual who is authorized to remove the seals indicating non-tampering of the watthour meter and/or the socket adapter/extender. Thus, two servicemen, one to remove the watthour meter and the other to service the additional features, may be required for a single service entrance. Also the power to the service will be disconnected requiring the customer to reset electrical or electronic devices due to the power outage.

Solutions to these problems are described hereafter.

SUMMARY OF THE INVENTION

In one aspect, the present invention is an apparatus for mounting an enclosure on a watthour meter socket adapter.

The apparatus includes a mounting strap lockingly encircleable about the side wall of a watthour meter socket adapter and an enclosure connected to the strap for positioning the enclosure externally adjacent to the side wall of the socket adapter.

Preferably, the interior of the enclosure is disposed in communication with the interior of the socket adapter through aligned apertures in the enclosure, the socket adapter and the strap to allow for the passage of electrical conductors therebetween.

A releasable lock means is carried on the strap for releasably locking the strap tightly about the side wall of the socket adapter. According to one aspect of the invention, the lock means comprises first and second members mounted on opposite ends of the strap and a fastener extendable through the first and second members for drawing the first and second members and the first and second ends of the strap into tightening engagement about the side wall of the socket adapter.

In one aspect, the enclosure includes a receiver having a first portion attached to the strap and a planar second wall portion. The first and second portions define a receptacle for the enclosure. The first portion is provided with spaced arcuate shoulders conformable with the annular side wall of the socket adapter. The second portion includes apertures alignable with apertures in the enclosure for receiving fasteners to mount the enclosure to the second wall portion of the receiver.

In another aspect, the strap is formed of first and second separate strap portions, each having first and second opposed ends. An aperture is formed in each first end of the first and second strap portions. The enclosure includes a through bore communicable with the interior of the socket adapter. The enclosure also includes first and second flanges. The first ends of the first and second strap portions are connected to the first and second flanges, respectively. An arm projects from each of the first and second flanges. The apertures in the first ends of the first and second strap portions are releasably engageable with the arm to attach one end of the first and second strap portions to enclosure.

According to another aspect of the invention, a projection extends from one of the enclosure and the side wall of the socket adapter and engages a mating channel formed in the other of the enclosure and the socket adapter for mechanically engaging the enclosure and the side wall of the socket adapter.

The apparatus of the present invention uniquely enables an external enclosure to be mounted externally adjacent the side wall of a watthour meter socket adapter without requiring modifications to the existing socket adapter design. Preferably, the apparatus enables the enclosure to be removably mounted on the socket adapter. More preferably, the apparatus enables the enclosure to be mounted on or removed from the socket adapter as well as enabling separate access to the interior of the enclosure without requiring the watthour meter mounted in the socket adapter to be removed from the socket adapter. This eliminates the need for a utility meter service person to make a service call to an existing watthour meter socket site to remove the watthour meter from the meter socket to enable access to an external receptacle mounted on the socket adapter in accordance with prior art constructions.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 1:
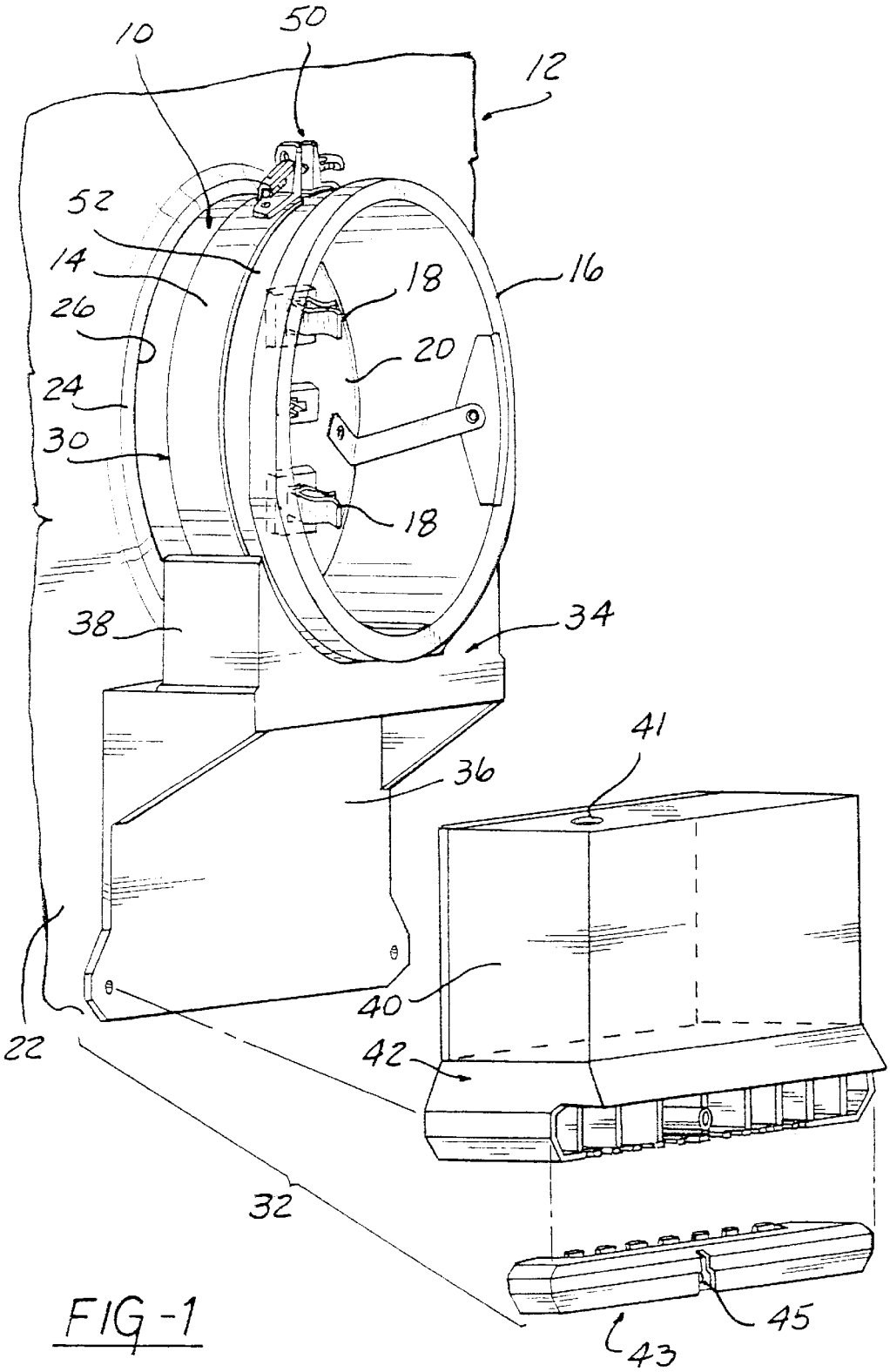
FIG. 1 is an exploded, perspective view of one embodiment of an apparatus for mounting an external enclosure or receptacle to a watthour meter socket adapter/extender.
Figure 2A:
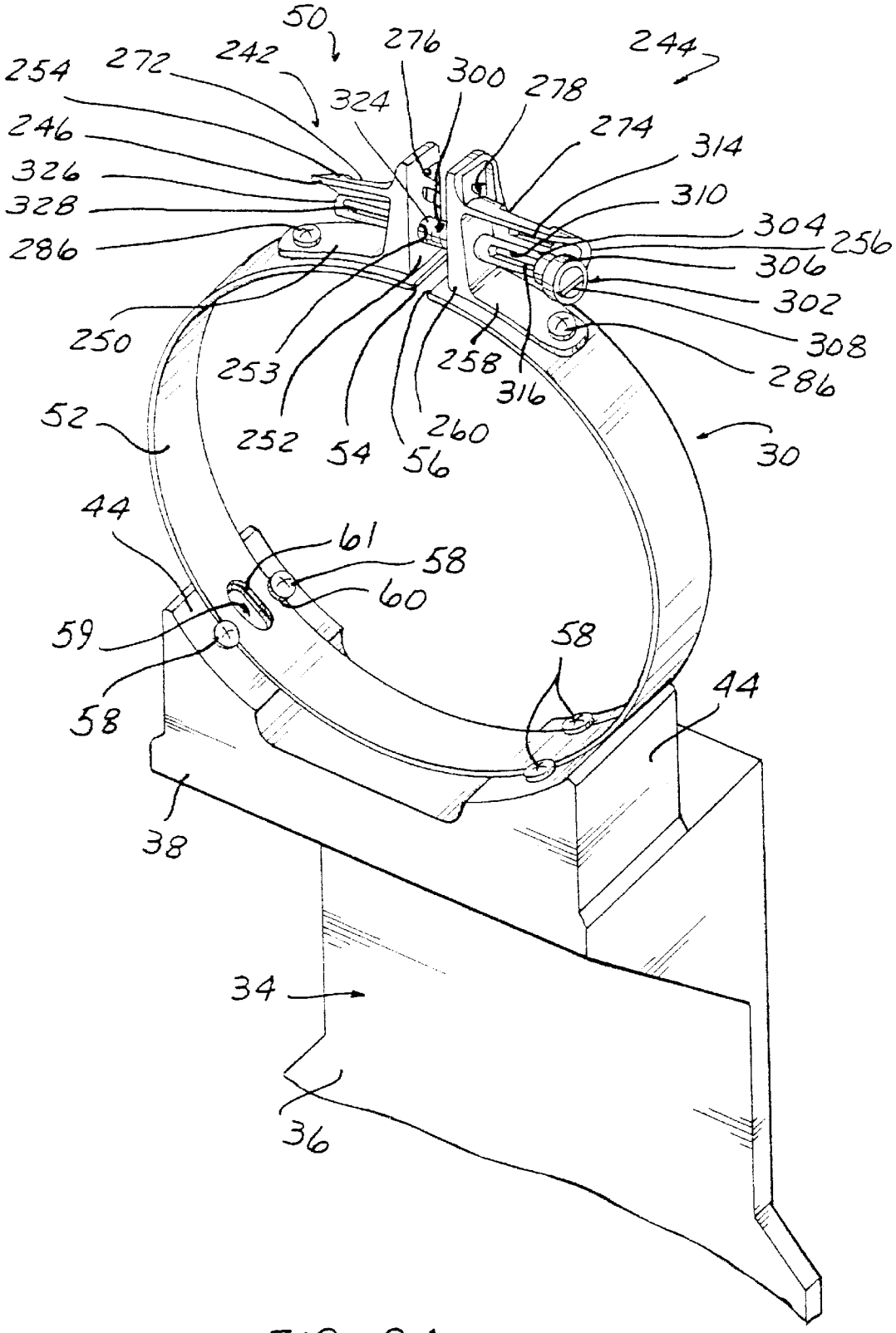
FIG. 2A is a perspective view of the mounting apparatus shown in FIG. 1 attached to an external enclosure.
Figure 9:
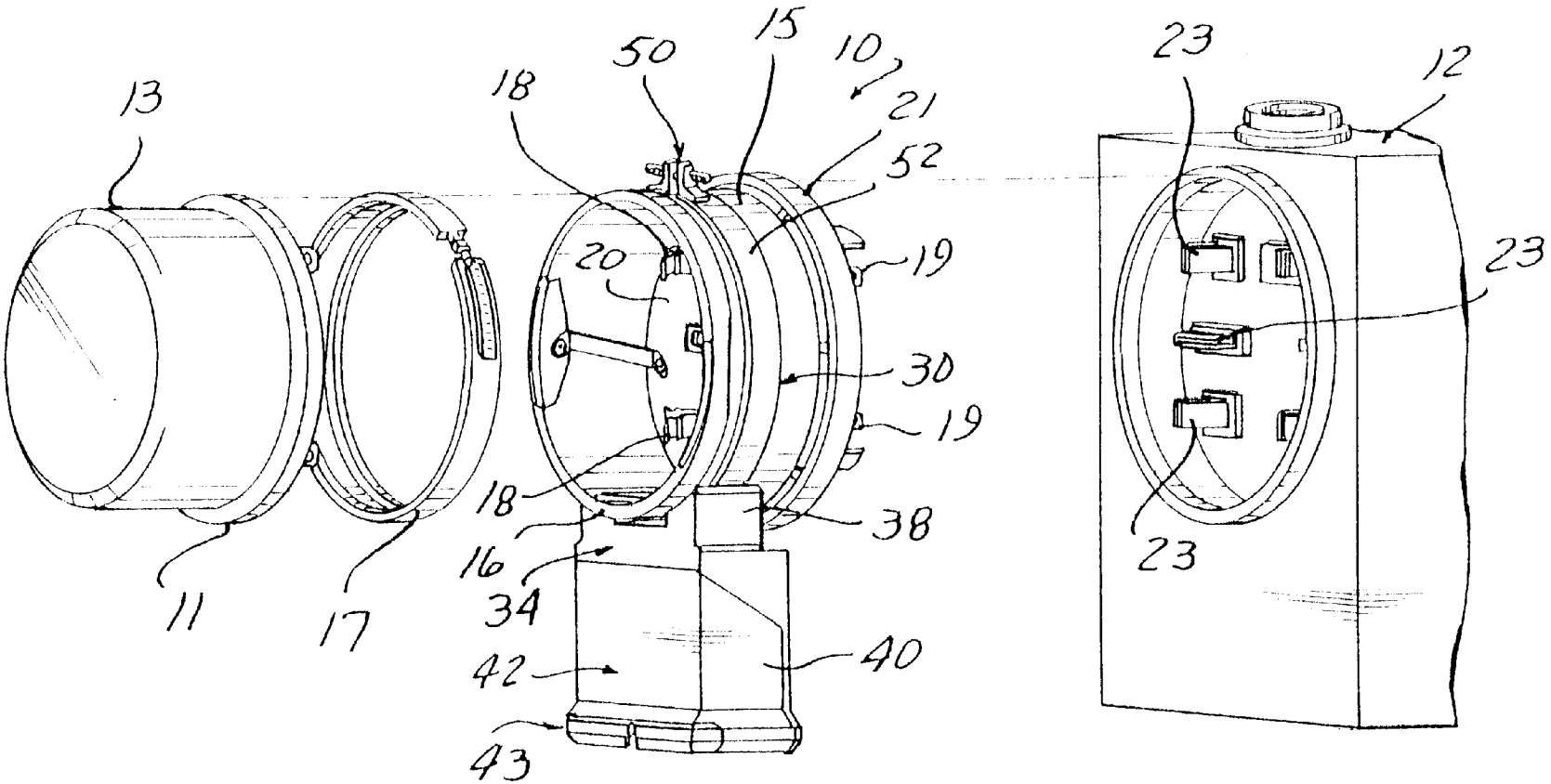
FIG. 9 is an exploded, prospective view showing a watthour meter, a watthour meter socket adapter and a watthour meter socket with which the present invention is used.

Referring now to FIGS. 1, 2A, and 9 there is depicted one embodiment of an apparatus used for fixedly, yet removably, mounting the auxiliary enclosure receptacle to a watthour meter socket adapter or watthour meter socket extender, both referred hereafter to as a socket adapter 10, mountable in a watthour meter socket 12.

The socket adapter 10 is of conventional construction and includes a generally cylindrical shell 14 with a sidewall 15 which is attached to a base, 21. A radially, outwardly extending, enlarged annular mounting flange 16 is formed at an outer end of the a sidewall 15 of the shell 14 for mating with a similar mounting flange 11 on a watthour meter, 13. Both flanges 11 and 16 receive a sealing ring 17. A plurality of jaw contacts 18 extend from a bottom wall 20 of the shell 14 and are connected to or integrally formed with blade terminals 19 which snap into jaw contacts 23 in the meter socket 12 in a conventional manner.

By way of example, the meter socket 12 is depicted as a ringless meter socket in which a cover 22 of the meter socket 12 has a raised annulus 24 surrounding an aperture 26 through which the shell 14 of the socket adapter 10 extends when the socket adapter 10 is engaged with the jaw contacts in the meter socket 12.

The mounting apparatus denoted generally by reference number 30 is provided for fixedly, yet removably, mounting an auxiliary enclosure or receptacle 32 to the shell 14 of the socket adapter 10 when the socket adapter 10 is mounted in the meter socket 12. Any type and shape auxiliary enclosure or receptacle 32 may be attached to the shell 14 by the mounting apparatus 30.

By way of example only, the enclosure 32 shown in FIGS. 1 and 2A is a pulse initiator automatic meter reading device. The enclosure 32 includes a holder 34 having a generally planar back wall 36 and an enlarged receiver 38 containing an interior cavity sized to receive the upper end 40 of an insert or housing 42 which carries the automatic meter reading circuitry, components and connections. The upper end portion of the receiver 38 is formed with two arcuate shoulders 44 which are complimentary in shape to the generally cylindrical shape of the shell 14.

A terminal cover 43 is mountable on the bottom end of the insert 42 for covering the terminal connections within the insert 42. A slot 45 in the terminal cover 43 receives a screw, not shown, for fixedly mounting the terminal cover 43 to the insert 42 as well as to enable a seal, also not shown, to be inserted through the screw to provide an indication of tampering with the terminal cover 43.

FIGS. 1 and 2A depict one embodiment of the mounting apparatus 30. The mounting apparatus 30 includes a strap or band 52 which is connected to the shoulders 44 of the holder 34 and is adapted for encircling the sidewall 15 of the exterior surface of the shell 14 of the socket adapter 10. A lock means 50 is carried on the strap 52 for releasably locking the opposed ends of the strap 52 about the sidewall 15 of the shell 14 of the socket adapter 10.

The strap 52 preferably comprises a single elongated strip or band which is formed of a high strength, flexible material, such as steel, stainless steel, aluminum, etc. It will be understood that the strap 52 may also be provided in at least two separate strap components or portions, as described hereafter, in other embodiments of the present invention.

The strap 52 has opposed ends 54 and 56. The strap or band 52 extends continuously, in this embodiment, between the opposed ends 54 and 56.

The strap 52 is fixedly connected to the enclosure, such as to the shoulders 44 of the holder 34 by means of fasteners 58. The fasteners 58 may extend directly through the strap 52 into threaded bores formed in the shoulders 44 of the holder 34. Alternately, the fasteners 58 engage notches 60 formed along the side edges of the strap 52 at appropriate locations to fixedly mount the strap 52 to the holder 34.

An aperture 61 is formed in the strap 52 at a position alignable with an aperture 59 in the shoulder 44 of the holder 34 when the strap 52 is affixed to the holder 34. The aligned apertures 59 and 61 form an opening for the passage of conductors between the shell 14 and the insert 42 through an aperture 41 in the upper end 40 of the insert 42. An optional gasket, not shown, may be interposed on the inner or outer surface of the strap 52 and provided with an aperture alignable with the apertures 59 and 61 to seal the apertures 59 and 61 from external water, dirt, etc.

Although the lock mechanism 50 described hereafter and shown in FIGS. 1 and 2A is preferred for locking the opposed ends 54 and 56 of the strap 52 about the sidewall 15 of the shell 14 of the socket adapter 10, it will be understood that other lock mechanisms, including conventional hose clamps or threaded lock mechanisms employed with watthour meter socket adapter sealing rings, etc., may also be employed.

The lock mechanism 50 includes first and second housings 242 and 244. Preferably, the housings 242 and 244 are formed of a molded or cast material. In a preferred embodiment, the housings 242 and 244 are formed as zinc die castings.

Further, the first and second housings 242 and 244 are formed as mirror images of each other except for a reverse threading of a threaded aperture in each housing 242 and 244 as described hereafter. Thus, the first housing 242 is formed with a first side wall 246 which extends outward from a base or bottom wall 250 and an end wall 252. A second side wall 254 extends angularly from one end of the first side wall 246, preferably perpendicularly therefrom.

Similarly, the second housing 244 is formed with a first side wall 256 which extends outward from a bottom wall 258 and an end wall 260. A second or top side wall 262 extends angularly from one end of the first side wall 256, preferably generally perpendicularly therefrom.

One end portion of the end walls 252 and 260 extends beyond the respective second side walls 254 and 262 to form grip tabs 264 and 266, respectively. A threaded aperture is respectively formed or molded in each end wall 252 and 260, such as threaded aperture 253 in the end wall 252.

A plurality of slots are formed in each housing 242 and 244 for receiving a security device, such as a wire seal therethrough. Apertures, in the form of slots 272 and 274, are respectively formed in the second side walls 254 and 262 of the housings 242 and 244.

Further, an additional aperture 276 and 278 is formed in the end walls 252 and 260 of the first and second housings 242 and 244, respectively. The apertures 276 and 278 enable a security device, such as a wire seal, to be extended through and joined between the two housings 242 and 244.

A unique mounting means is employed to securely fix each of the housings 242 and 244 to respective ends 54 and 56 of the annular strap or band 52. The bottom walls 250 and 258 of the housings 242 and 244, respectively, include at least one projection, not shown. The end of each projection is spaced from the respective bottom wall 250 and 258 to form a notch, also not formed. The projections extend progressively further away from the bottom wall 250 and 258 in the direction of the notch. This enables the interior edge of the notch to engage one edge of a slot formed in the central portion of the annular strap 52 to fix the position of one end of each of the housings 242 and 244 relative to the annular strap 52.

A mechanical fastener, such as a rivet 286, extends through aligned apertures, not shown, formed in the central portion of the strap 52 and the bottom wall 250 and 258 of each housing 242 and 244 at a position spaced from the notch. The fastener or rivet 286 in conjunction with the notched end serve to fixedly mount and position each of the housing 242 and 244 on opposite ends 54 and 56, respectively, of the annular strap 52.

A fastener 300, as clearly shown in FIG. 2, includes a head end 302 having a larger diameter than the diameter of an adjacent tubular shank 304. The head end 302 may be formed with flats. By example only, the head end 302 may also be formed of a plurality of circumferentially spaced depressions 306 which form a tool or finger grip surface. In addition, a recess 308 is formed in the head end 302 for receiving an Allen wrench or similar tool to effect bidirectional rotation of the fastener 300.

The tubular shank 304 extends axially from the head end 302 and includes a plurality of intersecting slots 310, etc., which are formed by axially extending, circumferentially spaced ribs 314, 316, etc. Three intersecting slots, only two of which are shown in FIG. 2, are preferably formed in the shank 304.

The tubular shank 304 terminates in a generally planar end extending perpendicular to a longitudinal axis of the fastener 300. An axially extending, reduced diameter shank extends axially from the end. The reduced diameter shank forms an annular recess between the end of the shank 304 and a threaded section 324. The reduced diameter shank is adapted to extend through an aperture formed in the end wall 252 of the housing 242 to enable the entire fastener 300 to freely move prior to threaded connection to the opposite housing 244 as described hereafter.

The threaded portion 324 extends axially from the reduced diameter section to a generally tubular second end 326. The threads 324 may be complete circular threads or partial threads formed on opposed sides or a portion of the fastener 300.

An axially extending, slot-shaped bore 328 extends transversely through the second end 326 of the fastener 300. A notch may be formed in the end of the second end 326 for receiving a suitable tool, such as a screwdriver, to effect rotation of the fastener 300 from the second end 326.

Suitable security devices, such as wire seals or plastic padlocks, not shown, may be secured through aligned apertures and slots in the housings 242 and 244 and the fastener 300 in a variety of positions depending upon the position of the fastener 300 relative to the slots in the housings 242 and 244 when the fastener 300 is rotated to completely tighten the strap 52 about the shell 14.

For example, a security device may be inserted through one of the slots 310, etc., in the first end of the fastener 300 and the slot 272 in the side wall 254 of the first housing 242. A security device may also be extended through and secured between the apertures 276 and 278 in the end walls 264 and 266 of the housing 242 and 244. In addition, a security device may be extended through the aperture 276 in the end wall 264 of the first housing 242, the slot 272 in the second side wall 254 in one of the slots 310, etc., in the first end of the fastener 300.

A security device, used by itself or in addition to another security device employed with the first housing 242, may also be passed through the second end 326 of the fastener 300 and the second housing 344. Another possible connection path includes the bore 328 in the fastener 300 and the slot 274 in the side wall 256 of the second housing 244. A security device may also be passed through the aperture 278 in the end wall 260, the slot 274 in the second side wall 262 and/or through the bore 328 in the second end 326 of the fastener 300.

In use, the strap 52 is attached to the holder 34 by means of the screws 58. The opposed ends 54 and 56 of the strap 52 are then separated to enable the strap 52 to be wrapped about the circumference of the shell 14 as shown in FIG. 1. The end 326 of the fastener 300 is then inserted into the aperture 253 in the housing 242 and rotated to threadingly pull the first and second housings 242 and 244 together. Finger pressure on the end walls 252 and 260 of the housings 242 and 244 respectively, aids in urging the housings 242 and 244 together thereby bringing the opposed ends 54 and 56 of the strap 52 tightly into engagement about the circumference of the shell 14.

Prior to mounting the insert 42 in the holder 34, conductors, not shown, extending through the aperture 59 in one shoulder 44 of the holder 34 and the aligned aperture 61 in the strap 52 are connected to conductors extending through an aperture 41 in the insert 42. Mating quick connectors may be provided on the conductors extending from the insert 42 and from the shell 14.

The insert 42 is then slidingly urged into the receiver 38 of the holder 34. Mounting screws may be inserted through the openings of the bottom of the insert 42 into threaded bores in the bottom of the back plate 36 of the holder 34.

The terminal cover 43 is then mounted in the insert 42 and a screw inserted through the slot 45 to fixedly mount the terminal cover 43 on the insert 42.

Figure 2C:
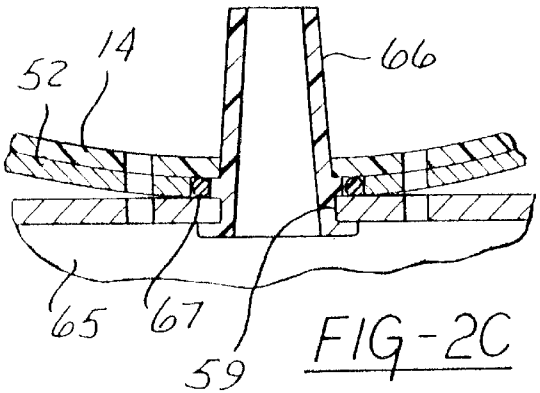
FIG. 2C is a cross-sectional view generally taken along line 2C—2C in FIG. 2B.
Figure 2B:
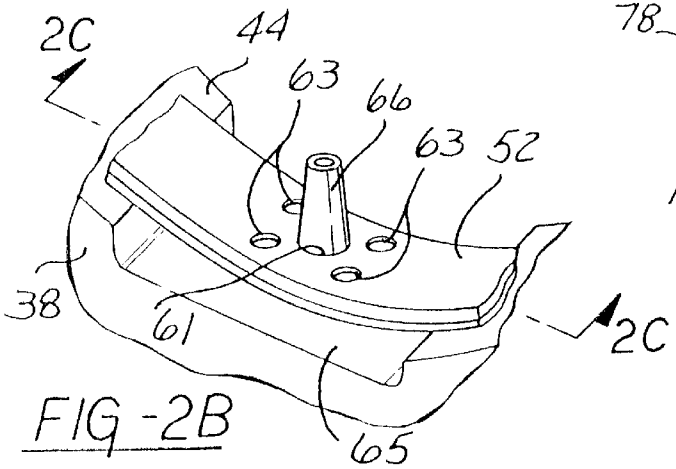
FIG. 2B is a partial perspective view of an alternate means for mounting the strap to the enclosure.

FIGS. 2B and 2C depict another means to affix the strap 52 to the holder 34. In this embodiment, four apertures 63 are formed in the strap 52 to align with four apertures in the flat 65 in the upper end 38 of the holder 34. The aperture 61 in the strap 52 is centered between the four apertures 63 and aligns with the aperture 59 in the flat 65. A hollow tubular member or nipple 66 is mounted at one end to the holder 34 in the flat 65 by means of an integral clip and extends through the apertures 59 and 61 and an aligned aperture in the shell 14. Alternately, the nipple 66 can be integrally molded as part of the holder 34. An O-ring seal 67 is disposed about the nipple 66 in the aperture 61 in the strap 52 to seal the shell 14 to the holder 34.

Figure 3:
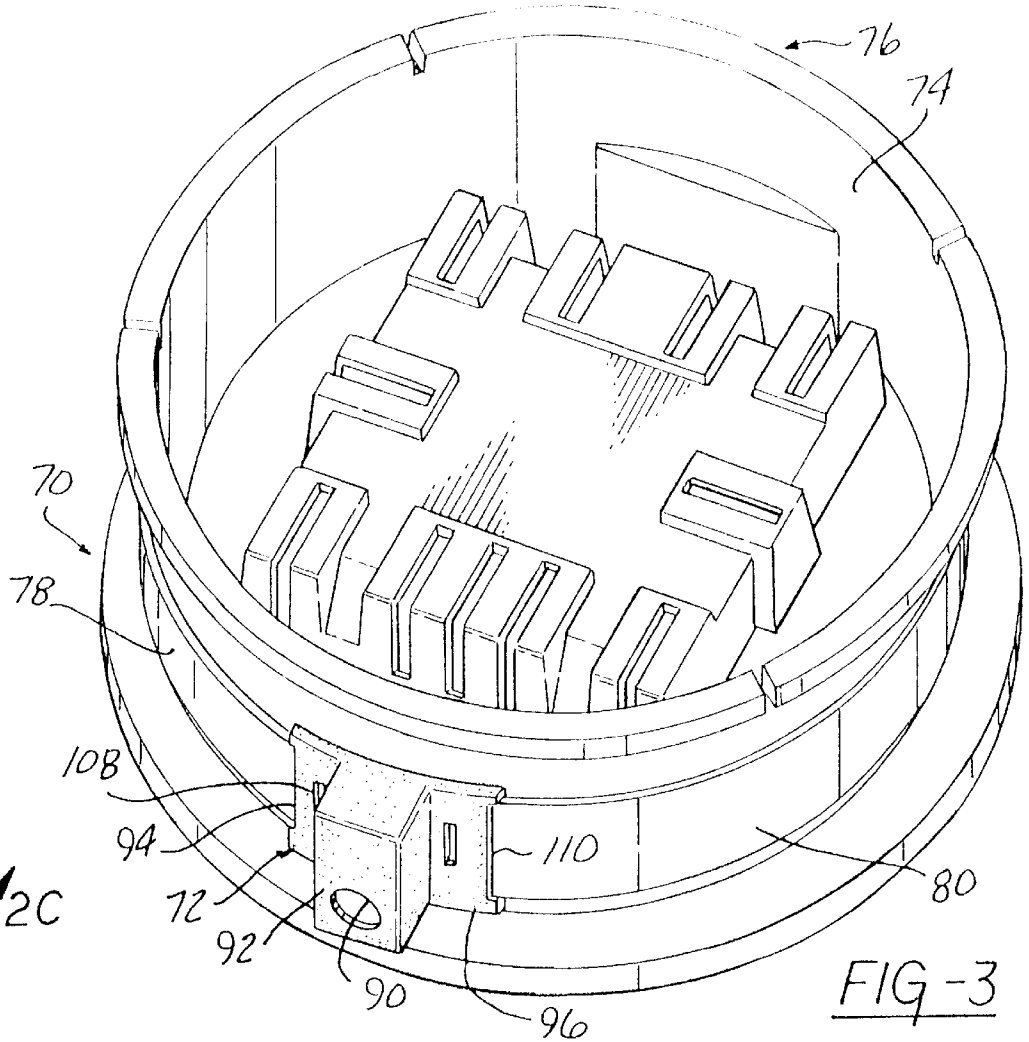
FIG. 3 is a perspective view of another embodiment of the mounting apparatus of the present invention used to mount a telephone jack receptacle on a watthour meter socket adapter/extender.
Figure 4:
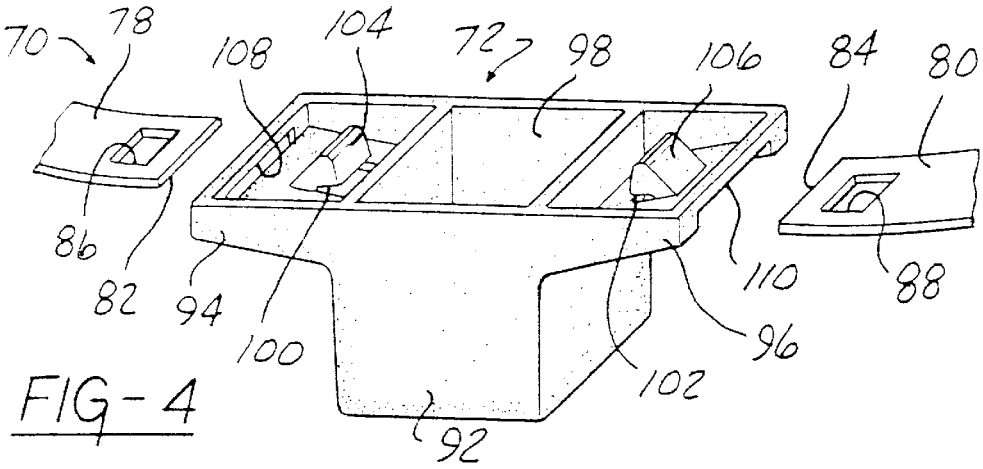
FIG. 4 is an exploded, perspective view of the mounting apparatus and telephone jack receptacle shown in FIG. 3.
Figure 5:
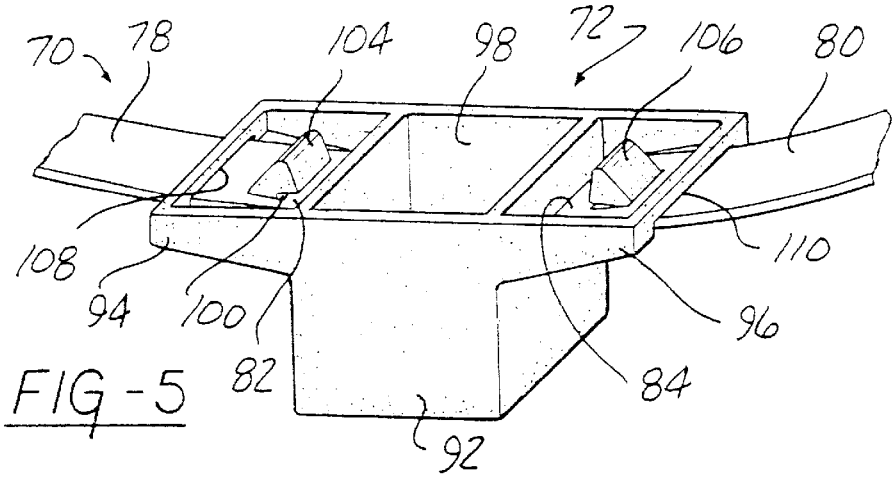
FIG. 5 is a perspective view of the assembled mounting apparatus and telephone jack receptacle of FIGS. 3 and 4.

Referring now to FIGS. 3–5, there is depicted another embodiment of a mounting apparatus 70 adapted for mounting an enclosure 72 to the annular side wall of a shell 74 of a watthour meter socket adapter/extender 76. In this embodiment, the mounting apparatus 70 is in the form of first and second straps 78 and 80. The straps 78 and 80 have first ends 82 and 84, respectively, and opposed second ends, not shown, which receive the lock housings 242 and 244 as described above and shown in FIGS. 1 and 2A. An aperture, typically in the form of a slot 86 and 88, is formed in each strap 78 and 80, respectively, adjacent to the ends 82 and 84 thereof.

The enclosure 72 is designed, by way of example only, for mounting a conventional telephone jack accessible through an aperture 90 formed in a bottom wall of the enclosure 72. As shown in FIGS. 3–5, the enclosure 72 has a generally T-shape formed of a stem 92 and a pair of upper, outwardly extending cross legs 94 and 96. A hollow cavity 98 is formed through the stem 92 and opens to the aperture 90 to allow for the passage of conductors, such as telephone conductors, through the stem 92 as well as to provide a space for mounting a conventional telephone jack within the stem 92.

A recess is formed in each cross leg 94 and 96 and includes an aperture 100 and 102, respectively. The apertures 100 and 102 are located below respective projections 104 and 106 integrally formed as part of each cross leg 94 and 96. A notch is formed on the bottom edge of each projection 104 and 106 adjacent to the apertures 100 and 102, respectively. Slots 108 and 110 are also formed through the end walls of cross legs 94 and 96 as shown in FIGS. 3 and 4.

As shown in FIGS. 4 and 5, the slots 108 and 110 receive the first ends 82 and 84 of straps 78 and 80. The straps 78 and 80 are inserted through the slots 108 and 110 until the apertures 86 and 88 slide over the respective projections 104 and 106. The straps 78 and 80 are then pulled outward from the stem 92 to bring the first ends 82 and 84 of the straps 78 and 80 into engagement with the notches formed below each projection 104 and 106. This firmly locks each strap 78 and 80 in the enclosure 72 as shown in FIG. 5. The straps 78 and 80 are then wrapped around the circumference of the shell 14 and the opposite ends locked together tightly about the shell 14 by the lock mechanism 50 described above and shown in FIGS. 1 and 2.

It should be noted that the enclosure 72 shown in FIGS. 3–5 is provided with an end surface contacting the shell 14 of the socket adapter 10 with a generally arcuate shape of substantially the same radius as the shell 14 to ensure a close mating engagement between the enclosure 72 and the shell 14.

Figure 8:
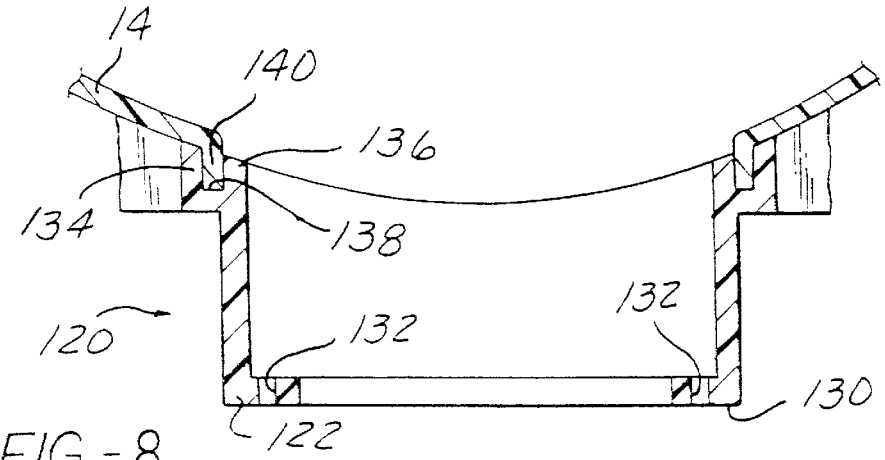
FIG. 8 is a cross-sectional view generally taken along lines 8—8 in FIG. 7.
Figure 6:
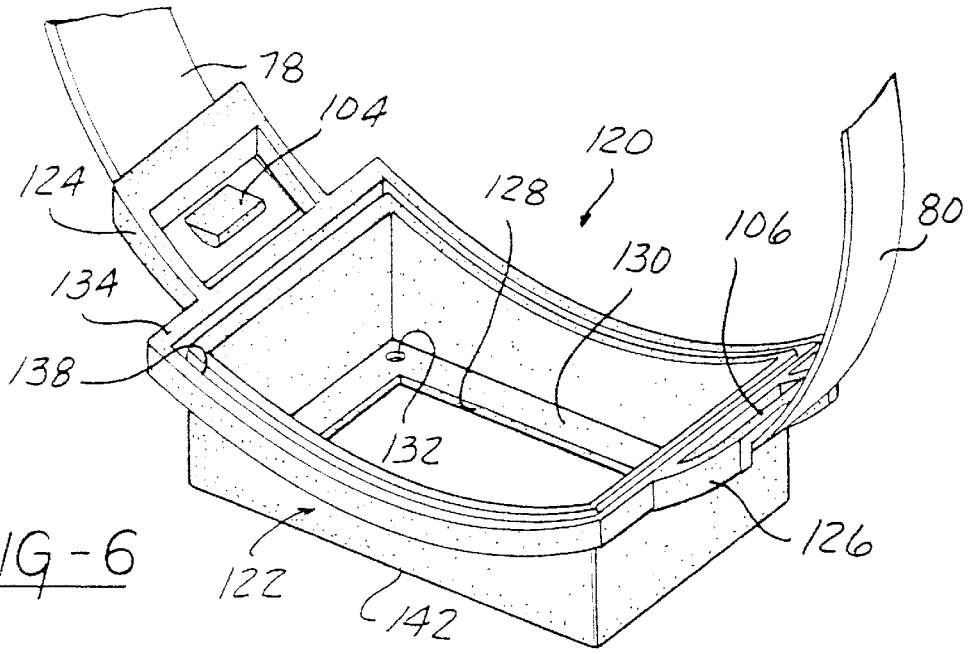
FIG. 6 is a partial, perspective view of another embodiment of the mounting apparatus of the present invention shown with a different enclosure mount.
Figure 7:
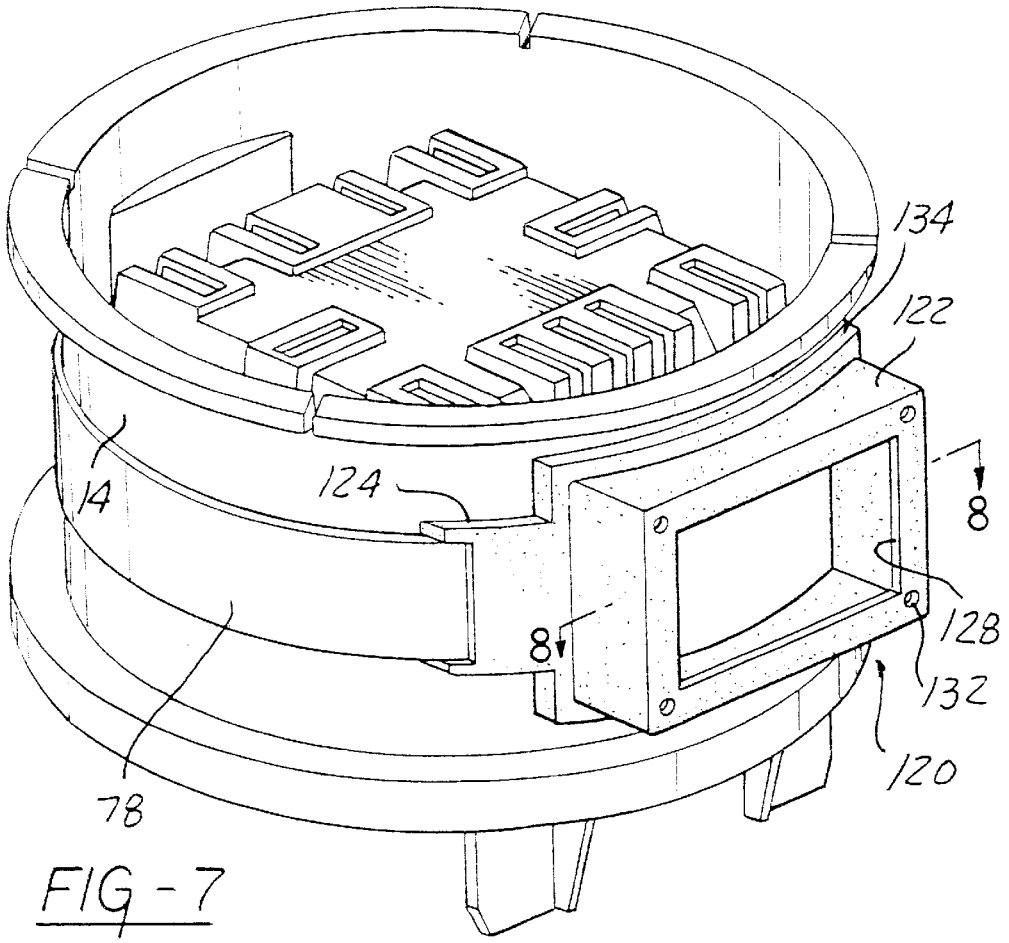
FIG. 7 is a perspective view of the mounting apparatus of FIG. 6 mounted on a watthour meter socket adapter/extender.

Another embodiment of a strap apparatus of the present invention is shown in FIGS. 6–8. In this embodiment, the two strap feature formed of first and second straps 78 and 80, described above and shown in FIGS. 3–5, is also employed. In addition, this embodiment also employs the notched projections 104 and 106 which engage the slots 86 and 88 in the ends of the straps 78 and 80 to affix the first ends 82 and 84 of the straps 78 and 80 to an enclosure 120.

As with the preceding embodiment, the enclosure 120 includes a stem 122 with two outwardly extending cross legs 124 and 126 which are integrally formed therewith and extend outward from one end of the stem 122. The cross legs 124 and 126 have a recess opening from an upper surface in which the projections 104 and 106, respectively, are formed along with a through aperture to enable the apertures 86 and 88 in the ends of the straps 78 and 80 to be slid over the projections 104 and 106 and then urged outward through slots formed in the outer ends of the cross legs 126 and 128 to secure the first ends 82 and 84 of the straps 78 and 80 to the cross legs 124 and 126 of the enclosure 120.

The stem 72 is a four sided body with an aperture 128 formed in a bottom wall leaving a flange 130. A plurality of fastener receiving apertures 132 are formed in the flange 130 for connecting an external enclosure, not shown, to the enclosure 120. An outer peripheral lip 134 is disposed laterally outward from the upper edge 136 of the side wall of the stem 122. A recessed notch 138 extending at least partially and preferably all the way about the periphery of the upper edge of the enclosure 120 is formed between the lip 134 and 136 in the upper edge. The recessed notch 138 is configured to receive a mating projection 140 integrally formed on and extending radially outward from the shell 14 of the socket adapter 10. Since the enclosure 120 has a generally rectangular shape in an exemplary embodiment, the projection 140 on the shelf 14 also has a mating rectangular shape to provide centering and mounting of the enclosure 120 to the shell 14.

The opposed bottom edge 142 of the enclosure 120, which includes the mounting flange 130, is generally planar or flat thereby enabling a flat edged external enclosure to be attached to the enclosure 120. The opposed top edge of the enclosure 120 defined by the peripheral lip 134, the upper edge 136, and the upper surface of the cross legs 124 and 126 have a continuously smooth arcuate shape generally at the same radius as the shell 14 to enable the enclosure 120 to be matingly engaged to the exterior surface of the shell 14.

In summary, there has been disclosed a unique apparatus for securely mounting an external enclosure or receptacle on an electrical apparatus, such as a watthour meter socket adapter. The apparatus is self-contained and, except for an aperture formed in one portion of the socket adapter to allow for the passage of conductors between the external enclosure and the interior of the socket adapter, no other modifications are necessary to the socket adapter. A variety of different receptacles or enclosures are mountable on a watthour meter socket adapter by the apparatus of the present invention. Such receptacles can be provided with separate access means to allow access to the interior of the enclosure separate from access to the interior of the socket adapter. More importantly, the mounting apparatus of the present invention enables the external enclosure to be mounted on and/or removed from the socket adapter as well as enabling access to the interior of the external receptacle without requiring the electrical watthour meter to be removed from the socket adapter.

What is claimed is:

1. An apparatus for mounting an enclosure on a watthour meter socket adapter having a side wall terminating in an outer mounting flange matable with a watthour meter mounting flange, the side wall of the socket adapter extending at least partially through an opening in a watthour meter socket cover, the apparatus comprising:

a mounting strap encirclingly mountable about the side wall of the socket adapter; and an enclosure connected to the strap for positioning adjacent the side wall of the socket adapter.

2. The apparatus of claim 1 wherein the enclosure comprises:

a holder having a first portion attached to the strap and a planar second portion, the first and second portions defining a receptacle for an insert.

3. The apparatus of claim 2 wherein:

the first portion is provided with spaced arcuate shaped shoulders conformable with a side wall of the watthour meter socket adapter.

4. The apparatus of claim 2 further comprising:

the second portion defines a wall; and fastening means engagable with the second portion of the holder to mount the insert to the second portion of the holder.

5. The apparatus of claim 2 wherein the strap is fixedly mountable on the holder.

6. The apparatus of claim 2 wherein the enclosure is disposed in open communication with the interior of the watthour meter socket adapter.

7. The apparatus of claim 6 further comprising:

an aperture in the strap, an aperture in the holder, and an aperture in the side wall of the socket adapter being disposed in communication for the passage of an electrical conductor therethrough.

8. The apparatus of claim 1 further comprising:

the interior of the enclosure disposed in open communication with the interior of the watthour meter socket adapter.

9. The apparatus of claim 1 further comprising:

releasable lock means, carried on the strap, for releasably locking the strap about the side wall of the watthour meter socket adapter.

10. The apparatus of claim 9 further comprising:

a sleeve interposed between the watthour meter socket adapter and the enclosure and defining a passage between the watthour socket adapter and the enclosure.

11. The apparatus of claim 9 wherein the lock means comprises:

first and second members mounted on the ends of the strap; and a fastener lockingly engageable with the first and second members for releasably coupling the first and second members and the opposed ends of the strap attached thereto in a releasable tightable engagement.

12. The apparatus of claim 1 wherein:

the strap is formed of first and second strap portions, each having first and second opposed ends, an aperture formed in each of the first ends of the first second strap portions;

the enclosure including a through bore and first and second flanges; and the first ends of the first and second strap portions connected to the first and second flanges, respectively.

13. The apparatus of claim 12 further comprising:

an arm formed on each of the first and second flanges of the enclosure; and the aperture in the first ends of the first and second strap portions engageable with one arm.

14. The apparatus of claim 1 further comprising:

a projection extending from one of the enclosure and the side wall of the socket adapter; and a mating channel formed in the other of the enclosure and the side wall of the socket adapter and interconnectable with the projection.

15. The apparatus of claim 14 wherein the projection includes at least one elongated wall.

* * * * *